United States Patent [19]

Fiske et al.

[11] Patent Number: 4,827,692

[45] Date of Patent: May 9, 1989

[54] MECHANISM FOR PACKAGING HAMBURGER PATTIES

[75] Inventors: Roger I. Fiske, Findlay; John J. King, Jenera, both of Ohio; David G. Adams, West Chester, Pa.

[73] Assignee: Keystone Foods Corporation, North Baltimore, Ohio

[21] Appl. No.: 113,320

[22] Filed: Oct. 28, 1987

[51] Int. Cl.[4] ..... B65B 5/06; B65B 5/10

[52] U.S. Cl. ..... 53/244; 53/247; 53/254

[58] Field of Search ..... 53/247, 254, 532, 541, 53/249, 244, 246

[56] References Cited

U.S. PATENT DOCUMENTS

| | | | |
|---|---|---|---|
| 2,556,214 | 6/1951 | Pottle | 53/254 X |
| 2,834,167 | 5/1958 | Loveridge . | |
| 3,299,613 | 1/1967 | Cella | 53/247 |
| 3,393,645 | 7/1968 | Mason, Jr. | 107/45 |
| 3,538,992 | 11/1970 | Chauhon | 198/35 |
| 3,650,086 | 3/1972 | Puhahn et al. | 53/254 X |
| 3,837,140 | 9/1974 | Golantsev et al. | 53/247 X |
| 3,927,508 | 12/1975 | Campbell | 53/251 |
| 4,209,960 | 7/1980 | Deutschlander | 53/502 |
| 4,236,855 | 12/1980 | Wagner et al. | 414/42 |
| 4,478,024 | 10/1984 | Vedvik et al. | 53/247 X |
| 4,648,237 | 3/1987 | Total | 53/247 X |

*Primary Examiner*—Horace M. Culver

*Attorney, Agent, or Firm*—Seidel, Gonda, Lavorgna & Monaco

[57] ABSTRACT

Mechanism for taking stacks of hamburger patties from a bottom-fed stacker and depositing them within a container in stacked alignment.

9 Claims, 8 Drawing Sheets

FIG. 7D
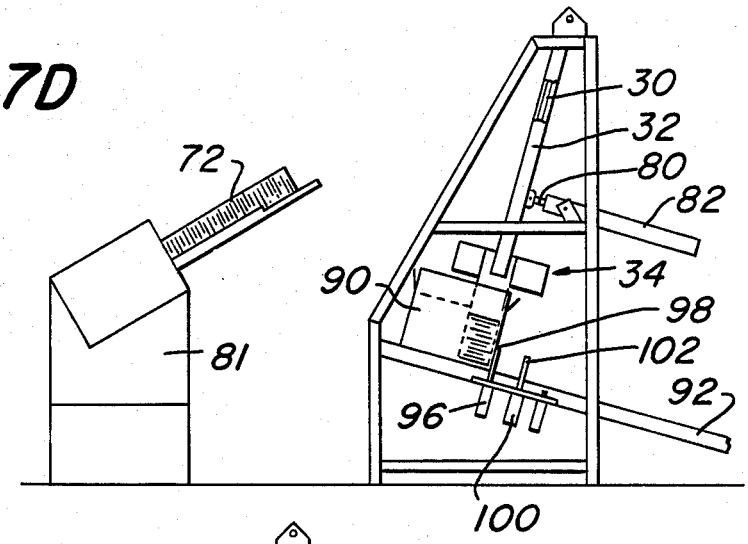
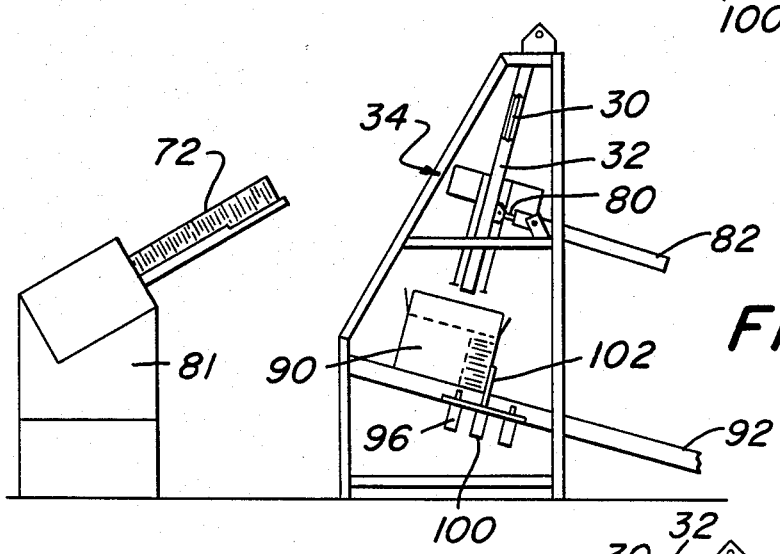
FIG. 7E
FIG. 7F
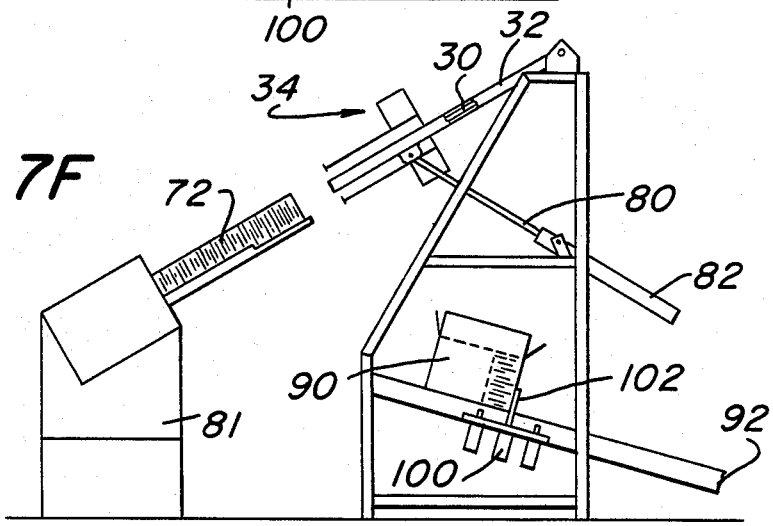

MECHANISM FOR PACKAGING HAMBURGER PATTIES

This invention relates to a machine for packaging disc-like objects, and more particularly to a machine for taking frozen hamburger patties in columnar form from a bottom-fed stacking machine and depositing them in stacked alignment within a suitable container.

It is a general object of this invention to provide means for automatically loading stacks of disc-like objects in a rectangular container.

A more particular object of the invention is to provide apparatus for removing stacks of frozen hamburger patties from a bottom-fed stacker and loading them in stacked alignment within a rectangular box.

It is the further object of the invention to provide apparatus capable of performing the above functions which is simple in construction, reliable in operation and relatively inexpensive to manufacture and use.

There are numerous types of prior art loading devices. U.S. Pat. No. 2,834,167, for example, discloses apparatus for loading milk bottles into cases and depicts the use of jaws having inturned hooks adapted to engage underneath the top beads of the bottles which are in turn released after deposit of the bottles into an empty bottle case.

U.S. Pat. No. 3,393,645 discloses apparatus for stacking tortillas including a counting mechanism consisting of a photoelectric arrangement for counting the articles as they interrupt the light source. When a predetermined number of articles has been reached, a solenoid valve is energized releasing air from pneumatic cylinders which cause rapid withdrawal of plates dropping a predetermined number of stacked tortillas onto a moving conveyor for further processing.

U.S. Pat. No. 3,538,992 relates to a device for handling discrete laminar articles and discloses means for dividing a supply of biscuits into batches ready for packaging. Biscuits are gravity fed into a chute. At the bottom of the chute biscuits are picked off one-by-one by fingers carried by a conveyor and deposited in notches of a stacker wheel from which they are deposited onto a conveyor.

U.S. Pat. No. 3,927,508 discloses apparatus for packaging items such as cookies arranged in a verticle array onto a moving conveyor belt for placement into a receptacle disposed on a tranversely moving conveyor.

U.S. Pat. No. 4,209,960 discloses apparatus for stacking disc-like articles by weight. Stacks are divided into specific lengths and then weighed. The results are used to adjust the position of a stop to provide the requisite number of articles.

U.S. Pat. No. 4,236,855 disclosed apparatus in which hamburger patties are sequentially accumulated on a moving belt through use of a gate following which they are stacked on individual carriers brought into position by support platforms carried by an elevator carriage mechanism to sequentially receive each succeeding article-laden carrier.

None of the above patents, however, disclose the unique apparatus comprising the instant invention and which utilizes a unique method of transporting flat disc-like objects in columnar form for disposition in aligned sequence within a rectangular container.

SUMMARY OF THE INVENTION

The present invention is directed to a loading machine for hamburger patties comprised of columnar structures of adjustable height which continuously accummulate bottom-fed frozen hamburgers. When a column of patties reaches a preset height, the patties are transferred to a receptacle or box. The box indexes forward as the machine arm returns to a home position and awaits for the accummulating patties to again reach the preset height to activate the next cycle. The machine can be operated pneumatically, hydraulically or electrically and may be controlled by any of a number of means including an electrical circuit, programmable controller or computer.

The specific sequence of operations for the machine is as follows. The patties are presented to the loader in the form of a continuously growing column from a bottom-fed stacking device of conventional construction. As the column grows, the patties move up troughs into the open fingers of a loader arm. The fingers are cylindrical rods with flared ends mounted on upper and lower parallel closing jaws. When the column reaches a preset adjustable height, a photobeam is interrupted and the cycle begins under control of an electrical circuit, a programmable controller or computer. This action effects closure of the jaws and movement of the finger rods into bearing engagement with side portions of the patties. The finger rods contain the column of patties as the flared finger ends separate the contained column from the remainder of the stack and exert a slightly greater pressure on the bottom pattie. The arms retract removing the column of patties from the stacker troughs thereby allowing space for more patties to accumulate while the loader is cycling. Once the retracting arm has cleared the stacker troughs it is swung into overlying relation with a suitable container. The arm next extends into the container and the jaws are opened releasing the patties. The arm is then retracted out of the container leaving the column of patties positioned in the container in predetermined alignment. The container or box sits on a conveyor at an angle sufficient to allow gravity to effect movement of the box upon its release after placement of each row of patties. The loader arm is then returned to its original position and is extended over the stacker troughs. As this occurs, the partially filled box is indexed forward to receive the next row of patties. After the final row is placed in the box, the box is conveyed away.

For the purpose of illustrating the invention, there is shown in the drawings a form which is presently preferred, it being understood, however, that this invention is not limited to the precise arrangements and instrumentalities shown.

DESCRIPTION OF THE DRAWINGS

FIGS. 7A–7F illustrate the sequence of operations carried out by the machine.

DETAILED DESCRIPTION

Figure 1:
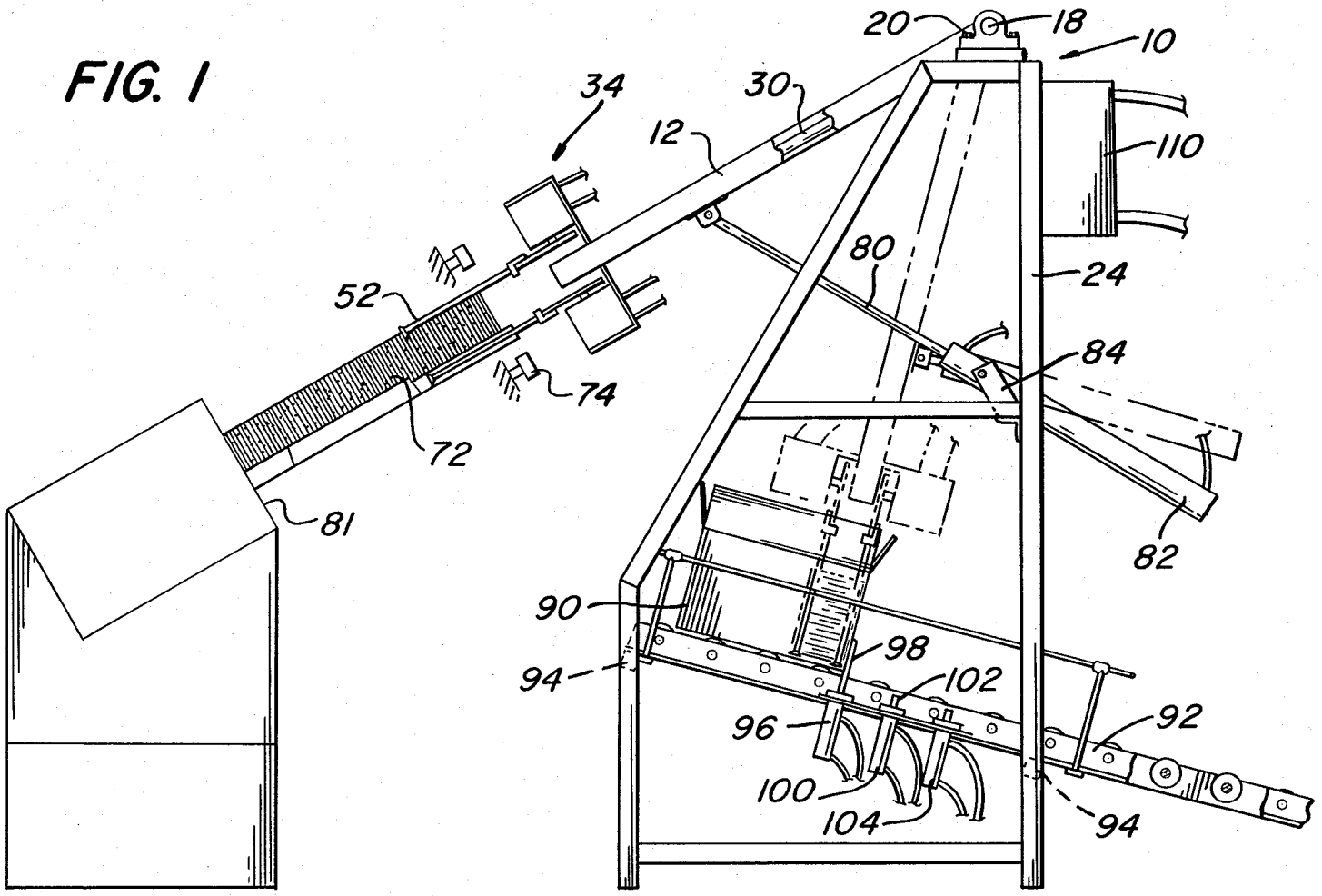
FIG. 1 is a side elevational view of a loading machine constructed in accordance with the present invention.
Figure 2:
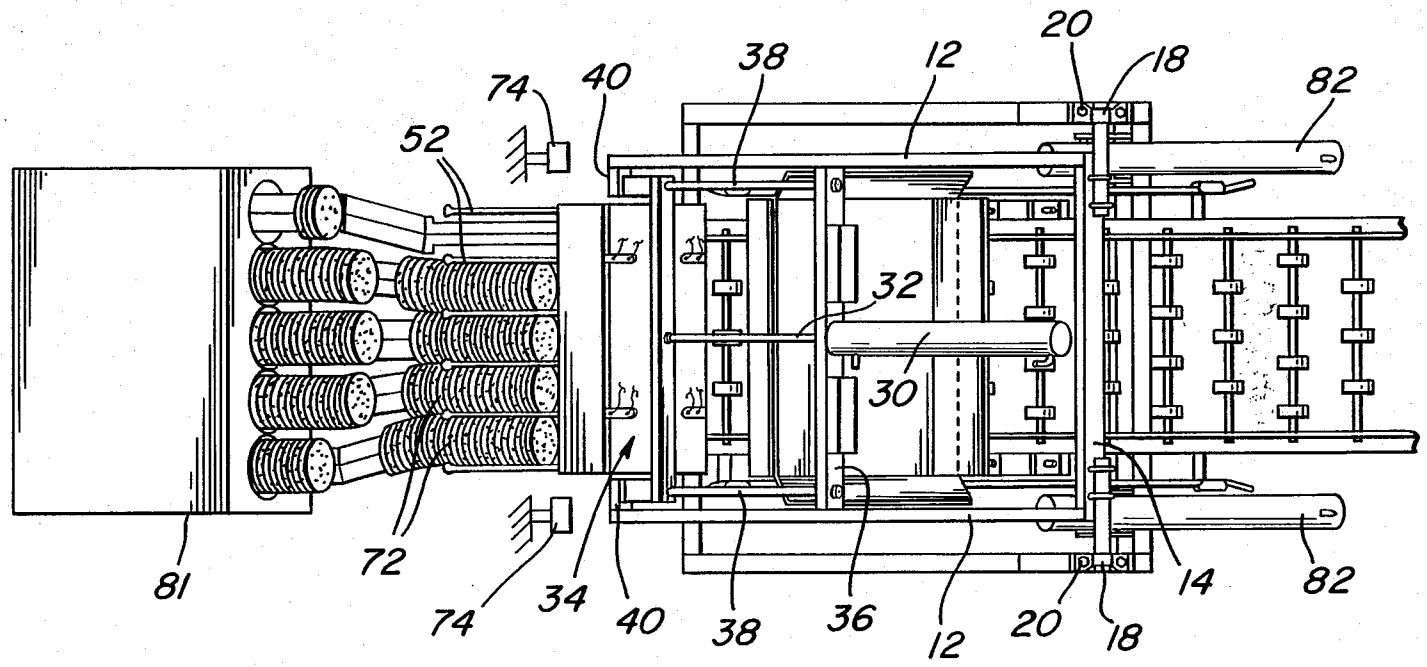
FIG. 2 is a top plan view of the loading machine.
Figure 3:
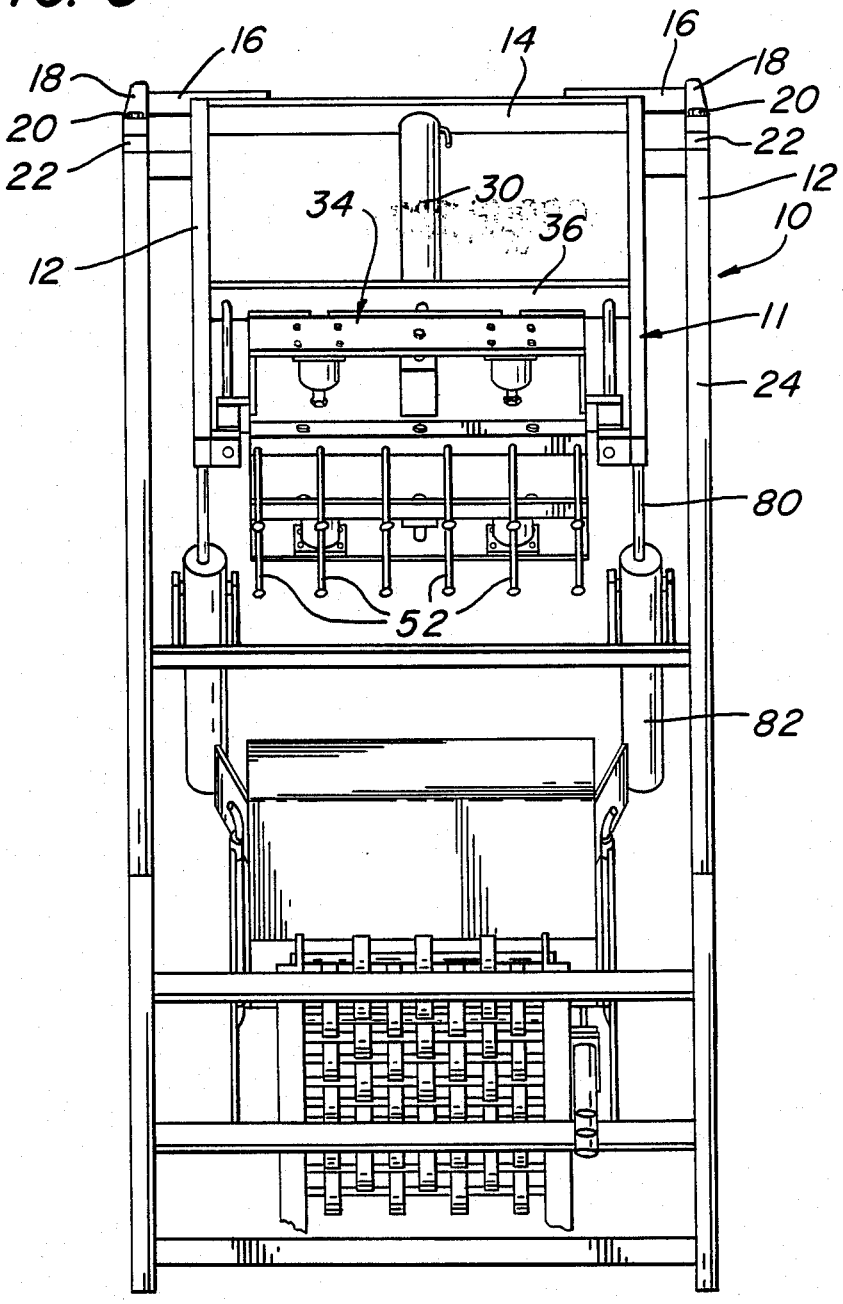
FIG. 3 is a front elevational view of the machine.

FIGS. 1–3 depict a stacking machine comprising a preferred embodiment of the invention. The machine is supported by an "A" frame 10 forming the main structural support for the unit. Pivoted to this structure for limited arcurate movement with respect thereto is a second or cylinder frame member 11 (FIG. 3) comprised of side and top members 12 and 14 respectively. Secured to upper surfaces of the top frame member 14 are pivot rods 16 carried in bearing blocks 18. The bearing blocks are in turn secured to the main frame 10 by bolts 20 which are received in threaded apertures provided in bearing-block mounting bars 22 secured to the top horizontal frame member 24 by welding or other suitable means.

Figure 4:
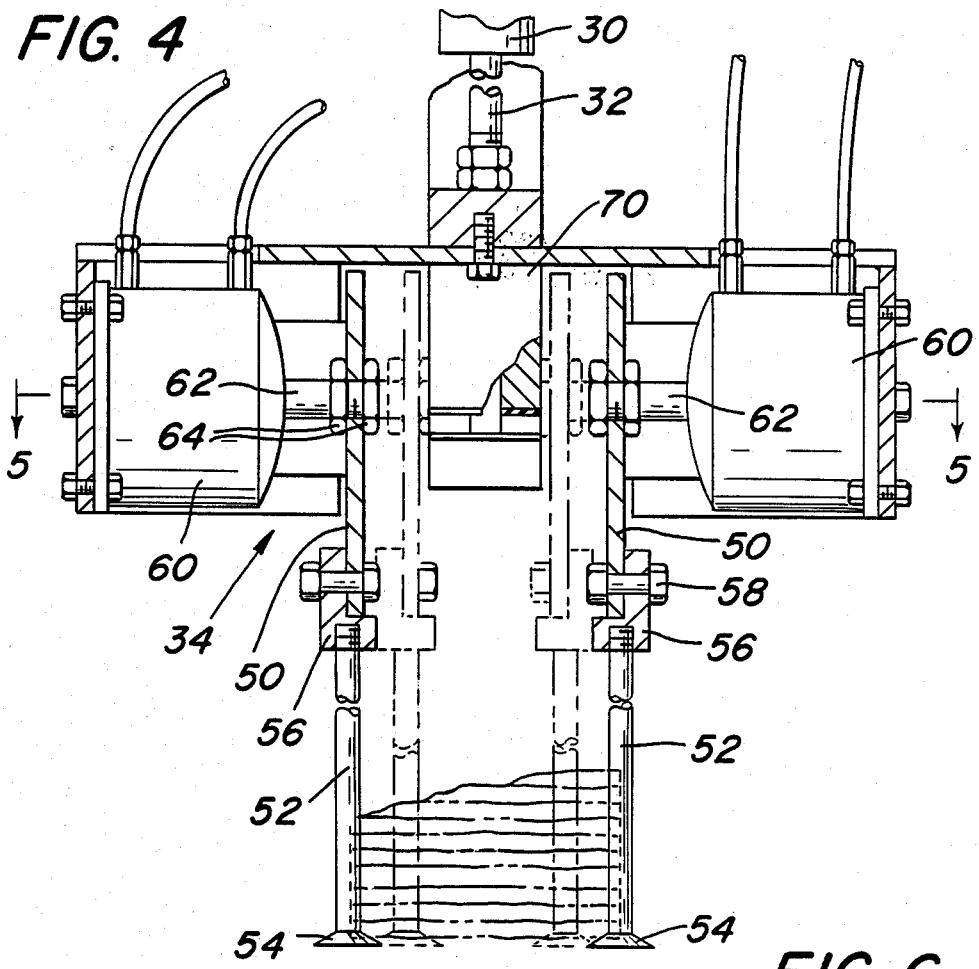
FIG. 4 shows constructional details of the of gripper fingers and jaw assembly.
Figure 5:
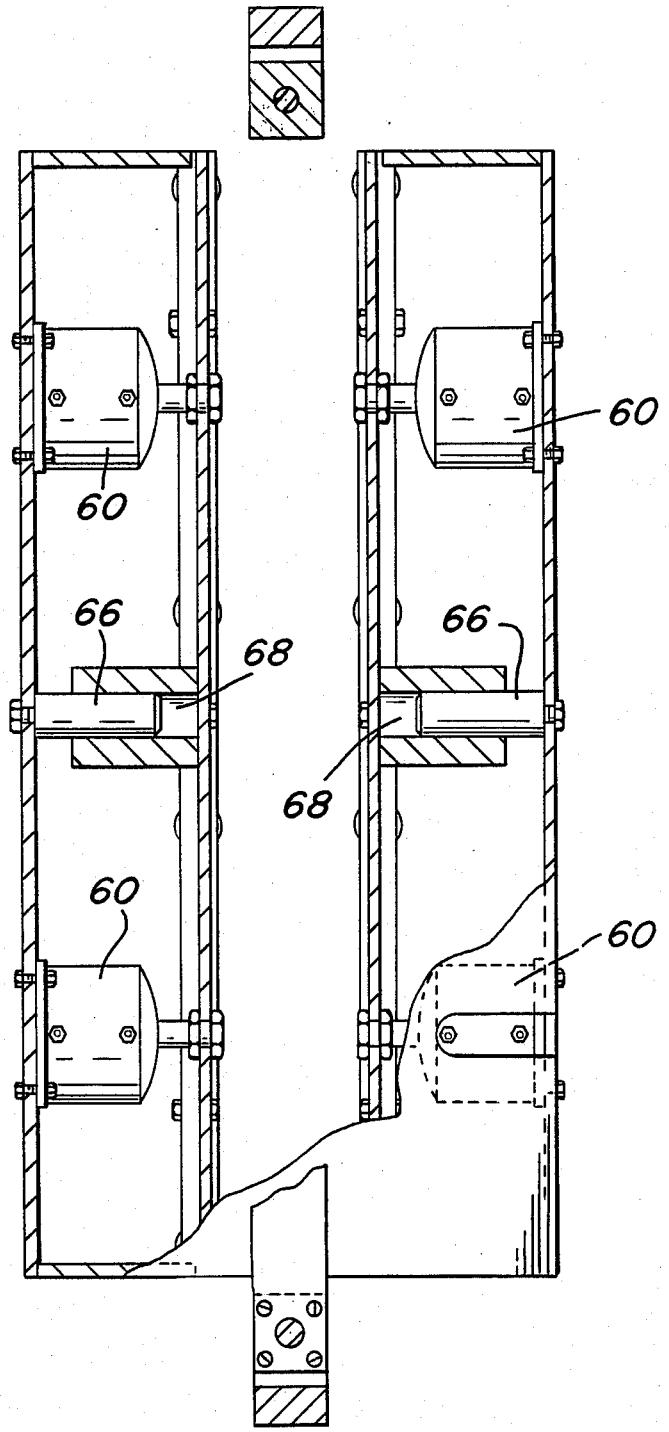
FIG. 5 is a sectional detail taken along the cutting plane 5—5 as seen in FIG. 4.

Mounted centrally on the cylinder frame top member 14 for rotation therewith is a pneumatically powered cylinder 30. The cylinder 30, by means of extension rod 32 (see FIG. 2), reciprocates the pattie gripper assembly 34 as hereinafter described. The cylinder frame assembly 11 has provided at approximately its midpoint a cross-bar 36. The cross-bar has fixedly mounted to it at either end slide rods 38. The slide rods are supported at their opposite ends to mounting blocks 40 secured to side members 12 of cylinder frame 11. Referring to FIGS. 4 and 5, the gripper assembly 34 comprises a pair of plates 50, each carrying a plurality of finger elements or rods 52 the ends 54 of which are flared. The rods are threadably seated in L-shaped bars 56. The bars are in turn removably secured to the plates 50 by bolts 58. The plates 50 are caused to move toward and away from each other by actuation of a pair of spring-biased cylinders 60, the pistons 62 of which are secured to the plates by lock nuts 64. When not energized, the plates are in the withdrawn cylinders shown in solid lines in FIG. 4. When the solenoids are energized, the plates and fingers 52 assume the position shown in phantom in FIG. 4. The plates are caused to move in parallel relationship through use of a plunger 66 constrained to move within a guide bearing 68 mounted to the movable plate 50 as seen in FIG. 5. The spacing of the plates 50 and the fingers 52, in the extended position, is controlled by a spacer bar 70.

Upon energization of the double acting cylinder 30, the gripper assembly 34 is extended into the position shown in FIG. 1, with the fingers 52 withdrawn into the solid line position shown in FIG. 4. This initial position is diagrammatically shown in FIG. 7A. This action brings the fingers or calipers 52 of the gripper assembly 34 into position overlying stacks of frozen patties 72 supplied by the stacker 80. The fingers remain in open position until the stack of patties reaches a predetermined height. At this point, the beam of a photodetector 74 is interrupted initiating programmed control of the sequence of operations shown in FIGS. 7A–7F.

Figure 6:
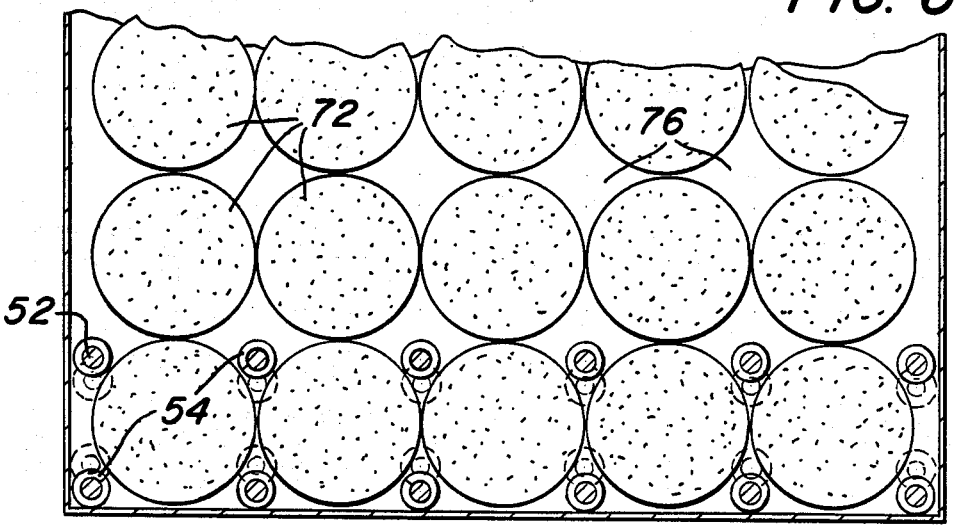
FIG. 6 is a partial plan view of a loaded container showing the positioning of the gripping fingers.
Figure 7A:
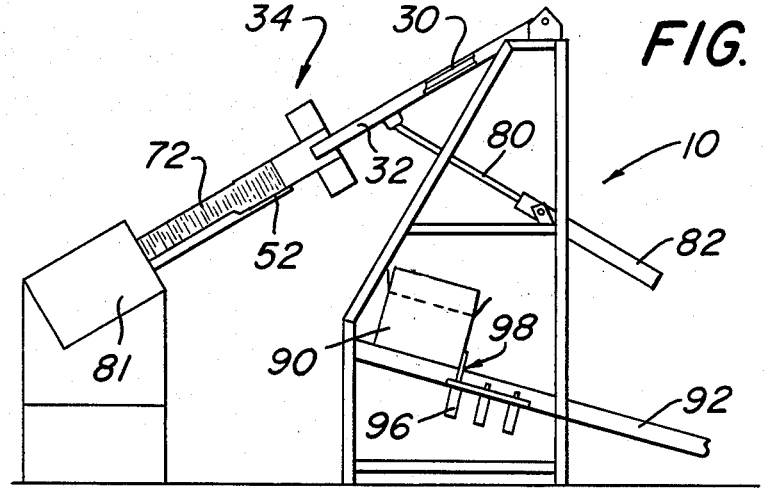
Figure 7B:
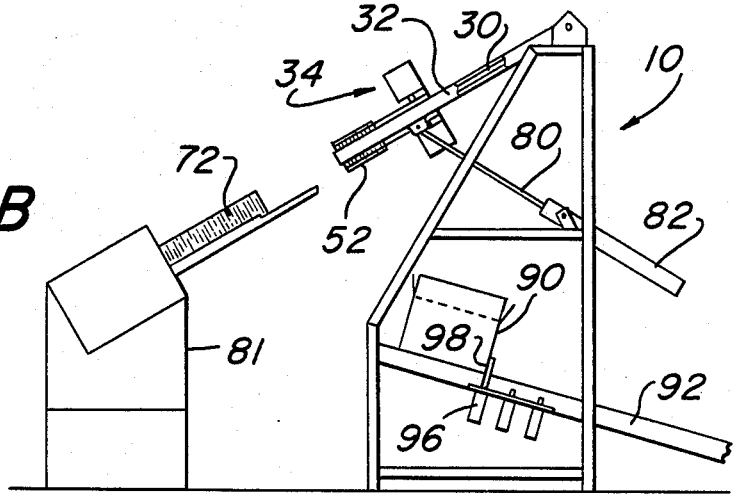
Figure 7C:
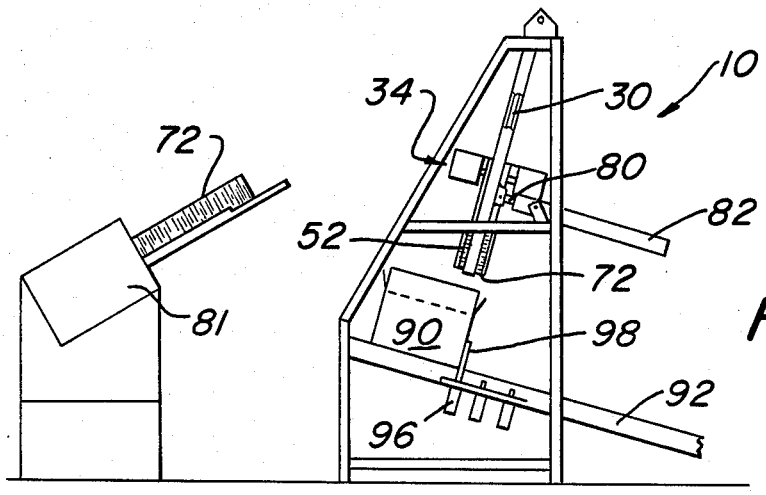

It is a unique feature of this invention that opposed pairs of fingers need only be moved in linear paths to effect gripping of edge portions of a circular object such as a frozen hamburger patty. This allows for simplification of the gripping mechanism with attendant reduction in cost of manufacture and reliability of operation. As seen in FIG. 6 the fingers 52 are designed for placement in the naturally occurring empty spaces 76 which result when a circular object is placed in a rectangular box. Gripping and release of circular objects can be achieved simply by moving the fingers in linear paths toward or away from each other. Each finger is flared at its distal end to provide support for the stack to be transferred and to act to separate the last pattie in the contained stack from the remainder of the stack. As mentioned previously, closure of fingers 52 is limited by a spacer bar 70 to prevent overtravel and consequent damage to the object being seized. Following closure of fingers 52, pneumatic cylinder 30 is actuated, retracting extension rod 32 as shown in FIG. 7B. Valve means, not shown, are next activated causing retraction of extension rods 80 of double acting pneumatic cylinders 82 carried in clevis mounts 84 secured to main frame 10. This action swings the gripper assembly into overlying relation with a container 90 positioned on a non-powered conveyor 92 supported on cross beams 94 welded to the main frame. The cross beams 94 are mounted to frame 10 so that the conveyor is inclined at an angle of 15° with the horizontal. The box is retained in its initial position on the conveyor by a pair of pneumatically operated cylinders 96 secured to the edge of the conveyor, the piston or extension rods 98 of which are caused to extend into the path of movement of the box to prevent its gravity-biased movement down the conveyor. With the gripper assembly and contained patties in position over the box, FIG. 7C, the cylinder 30 is activated, extending rod 32 and positioning the patties within the box enclosure as shown in FIG. 7D. The gripper assembly is then opened, releasing the stack of patties. The extension rod 32 of cylinder 30 is then retracted, FIG. 7E, followed by activation of cylinders 82 which extends rods 80, rotating cylinder 30 and the gripper assembly 34 counter-clockwise 45° into the position shown in FIG. 7F. Cylinder 30 is then activated extending the calipers into overlying position over the stack of accumulating patties as seen in FIG. 7A to repeat the process.

As the gripper assembly 34 is recycled to pick up another stack of patties, the box is gravity fed into a second position by retraction of piston rod 98 and activation of a pair of cylinders 100 which extends piston rods 102 into interfering relation with the box to permit its limited advance so as to be in position to receive the next batch of stacked patties.

Figure 8:
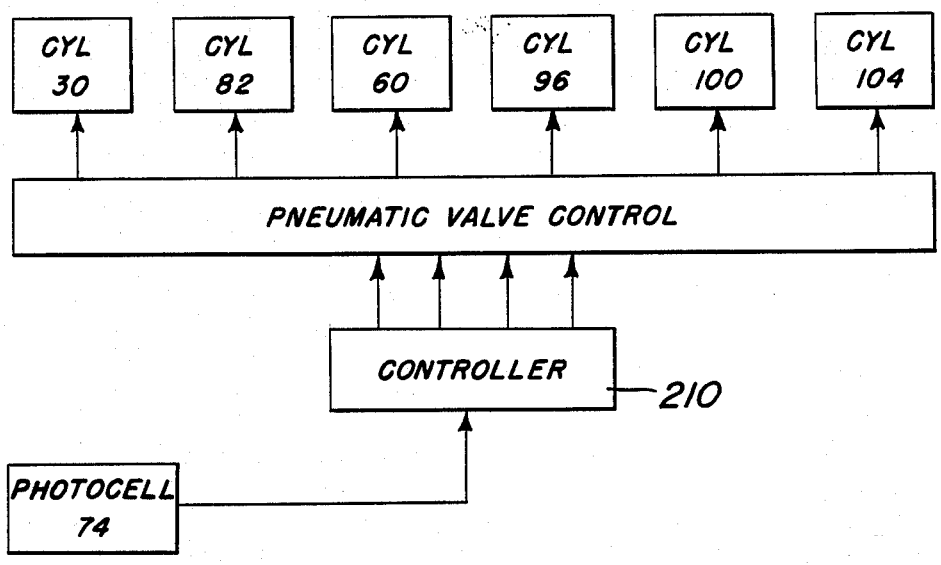
FIG. 8 depicts means for effecting controlled sequencing of events.

The means for operating the machine may be pneumatic, as described, hydraulic or electrical and may be controlled by computer, electrical circuit or by a programmable controller. One form of control means for sequencing the various events is shown in FIG. 8. Controller 110 is activated by a signal derived from photocell 74. The controller, through a series of pneumatically controlled valves, effects sequential operation of cylinder 60, cylinder 30, cylinder 82 and cylinders 96, 100 and 104 as previously described.

The present invention may be embodied in other specific forms without departing from the spirt or essential attributes thereof and, accordingly, reference should be made to to the appended claims, rather than to the foregoing specification, as indicating the scope of the invention.

We claim:

1. Mechanism for gripping a stack of disc-like objects and depositing it in a container, comprising:

gripping means including opposed pairs of fingerlike elements, means for orienting said gripping means such that said finger-like elements are disposed in open array around said stack of disc-like objects, means for moving said opposed pairs of said fingerlike elements in linear paths towards each other and into contact with peripheral portions of said stack of objects, means for moving and orienting said gripping means and stack of objects within a container and means for releasing said stack of objects from said finger-like elements by causing said opposed pairs of said finger-like elements to move in a linear path away from each other.

2. Mechanism for gripping a stack of disc-like objects and depositing them in a rectangular receptacle, comprising:

gripping means including pairs of opposed fingerlike elements the ends of which are flared, means for positioning said finger-like elements in open array around a stack of disc-like objects, means for moving opposed pairs of said fingerlike elements in linear paths toward each other and into contact with peripheral portions of said stack and such that portions of said flared ends underlie bottom portions of the lowermost one of said objects in a stack, means for positioning said gripping means and contained stack within said receptacle and means for releasing said stack from said fingers by causing opposed pairs of said finger-like elements to move in linear paths away from said stack.

3. Mechanism for gripping stacks of disc-like objects and depositing them in a rectangular receptacle, comprising:

gripping means including opposed pairs of fingerlike elements the ends of which are flared, means for positioning a plurality of said finger-like elements in open array around individual ones of said stacks, means for simultaneously moving opposed pairs of said finger-like elements in linear paths into contact with peripheral portions of said stacks and such that portions of said flared ends underlie bottom portions of the lowermost objects in individual ones of said stacks, means for placing said gripping means and contained stacks within a rectangular container and means for simultaneously releasing said stacks from said finger-like elements by causing opposed pairs of elements to move in linear paths out of contact with said stack.

4. Mechanism for placing stacks of frozen hamburger patties in a rectangular container, which comprises:

gripping means including opposed pairs of rod-like elements, the ends of which are flared, first means for extending said gripping means into a first position in which said elements are disposed in open array around a stack of hamburger patties, means for causing opposed pairs of said fingers to move in linear paths into contact with peripheral portions of said stack and such that said flared ends underlie bottom portions of the lower-most patty of a stack to form a support for the stack, means for transferring the stack of hamburger patties contained within said elements from said first position to a second position overlying a rectangular container and means for positioning said elements and contained stack within said container and means for releasing said stack into said container by causing opposed pairs of said elements to move in linear paths away from said stack.

5. Mechanism for transferring stacks of frozen hamburger patties from a bottom-fed stacker to a rectangular container and for depositing same in stacked alignment therein, which comprises:

a plurality of troughs onto which said patties are fed by said stacker, gripping means including at least two pairs of finger-like elements the ends of which are flared, first means for extending said gripping means into a position in which said finger-like elements are disposed in open array around a stack of hamburger patties supported on a trough, means for causing opposed pairs of said fingers to move in linear paths into contact with peripheral portions of said stack and such that the flared ends of said fingers underlie bottom portions of the lower-most patty of the stack to form a support for the stack, means for withdrawing said fingers and contained stack of patties from the trough, means for moving said gripping means and contained stack into overlying relation to said container, means for placing said fingers and contained patties within said container, and means for releasing said stack from said fingers by causing opposed pairs of said fingers to move in linear paths away from said stack.

6. Mechanism for transporting stacks of frozen hamburger patties from a bottom-fed stacker to a container and for depositing same in stacked alignment therein, which comprises:

a plurality of obliquely oriented troughs onto which said patties are fed by said stacker, gripping means including a plurality of opposed pairs of rod-like finger elements the ends of which are flared, first pneumatically operated means for extending said gripping means into a position in which said finger elements are disposed in open array around a stack of hamburger patties supported on a trough, means for causing opposed pairs of said fingers to move in linear paths towards each other and into contact with peripheral portions of said stack and such that said flared ends underlie bottom portions of the lower-most patty to form a support for the stack, means causing said first pneumatic means to retract said gripping means with its retained stack of patties clear of said trough, second pneumatically operated means for moving said gripping means and contained stack away from said trough and into alignment over said container and means causing said first pneumatically operated means to extend said gripping means to position said finger elements and contained stack within said container and means for moving said fingers in linear paths away from each other to thereby release said stack for deposit within the container.

7. The mechanism of claim 7 in which there are a plurality of said gripping means acting in synchronism.

8. The mechanism of claim 8 including means for indexing said container to receive successive deposits of stacked patties.

9. The mechanism of claim 9 wherein the motive force for the movement of said container into successive indexed positions is gravity.

* * * * *